US006932556B1

(12) United States Patent
Ecker

(10) Patent No.: US 6,932,556 B1
(45) Date of Patent: Aug. 23, 2005

(54) SLAB TIPPING APPARATUS

(76) Inventor: Jeffrey M. Ecker, N 3483 Hwy. 55, Chilton, WI (US) 53014

( * ) Notice: Subject to any disclaimer, the term of this patent is extended or adjusted under 35 U.S.C. 154(b) by 116 days.

(21) Appl. No.: 10/347,072

(22) Filed: Jan. 17, 2003

(51) Int. Cl.[7] ..... B66F 9/18

(52) U.S. Cl. ..... 414/724; 414/741; 414/912; 414/607; 414/663; 414/620

(58) Field of Search ..... 414/607, 620–622, 414/663, 724, 732, 738, 741, 768, 770; 37/403; 294/119.1

(56) References Cited

U.S. PATENT DOCUMENTS 3,455,477 A * 7/1969 Blair ..... 414/704
4,187,049 A * 2/1980 Jones ..... 414/704
4,266,819 A 5/1981 Pemberton
4,403,906 A 9/1983 Holopainen
4,659,277 A 4/1987 Widener
4,863,338 A * 9/1989 Johnson ..... 414/704
D346,259 S 4/1994 Laatsch
5,957,650 A 9/1999 Rollo
6,098,320 A 8/2000 Wass

* cited by examiner

*Primary Examiner*—Eileen D. Lillis
*Assistant Examiner*—Mark A. Deuble

(57) ABSTRACT

A slab tipping apparatus for tipping slabs onto forks of a forklift. The slab tipping apparatus includes a base member being designed for being selectively coupled to a carriage of the forklift. A pivoting assembly is coupled to the base member. The pivoting assembly is designed for being selectively to the carriage of the forklift whereby the pivoting assembly extends between the base member and the carriage of the forklift. The pivoting assembly is designed for being actuated by a user for pivoting the base member with respect to the carriage of the forklift. An arm member slidably engages the base member whereby the arm member is selectively extendable from the base member. The arm member is designed for engaging an edge of the slab whereby the arm member tips the slab onto the forks of the forklift when the pivoting assembly pivots the base member.

17 Claims, 4 Drawing Sheets

SLAB TIPPING APPARATUS

BACKGROUND OF THE INVENTION

1. Field of the Invention

The present invention relates to material handling devices and more particularly pertains to a new slab tipping apparatus for tipping slabs onto forks of a forklift.

2. Description of the Prior Art

The use of material handling devices is known in the prior art. U.S. Pat. No. 4,403,906 describes a device for helping load material into the bucket of a front end loader. Another type of material handling device is U.S. Pat. No. 4,659,277 having a forklift attachment with a pair actuated arms that engage a load on the forks of a forklift to stabilize the load on the forks. U.S. Pat. No. 6,098,320 has a digger with a plurality of tines that is operationally coupled to a front end loader to used to dig into the earth and grip onto debris to be removed from the area. U.S. Pat. No. 5,957,650 has a grappling device that is coupled to a bucket of a front end loader to assist in securing material to bucket of the front end loader to be moved by the user. U.S. Pat. No. 4,266,819 has a grapple apparatus that is coupled to the carriage of the forklift to help stabilize poles and pipes positioned in the forks of the forklift. U.S. Pat. No. Des. 346,259 shows a fork lift truck.

SUMMARY OF THE INVENTION

An object of the present invention is to provide a new slab tipping apparatus that inhibit the user from being injured by allowing the slab tipping apparatus to actuated by the user positioned in the cab of the forklift.

Even still another object of the present invention is to provide a new slab tipping apparatus that reduces the amount of breakage of slabs by allowing the user to control the slab being placed onto the forks of the forklift.

To this end, the present invention generally comprises a base member being designed for being selectively coupled to a carriage of the forklift whereby the base member is pivotal with respect to the carriage of the forklift. A pivoting assembly is coupled to the base member. The pivoting assembly is designed for being selectively coupled to the carriage of the forklift whereby the pivoting assembly extends between the base member and the carriage of the forklift. The pivoting assembly is designed for being actuated by a user for pivoting the base member with respect to the carriage of the forklift. An arm member slidably engages the base member whereby the arm member is selectively extendable from the base member. The arm member is designed for engaging an edge of the slab whereby the arm member tips the slab onto the forks of the forklift when the pivoting assembly pivots the base member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
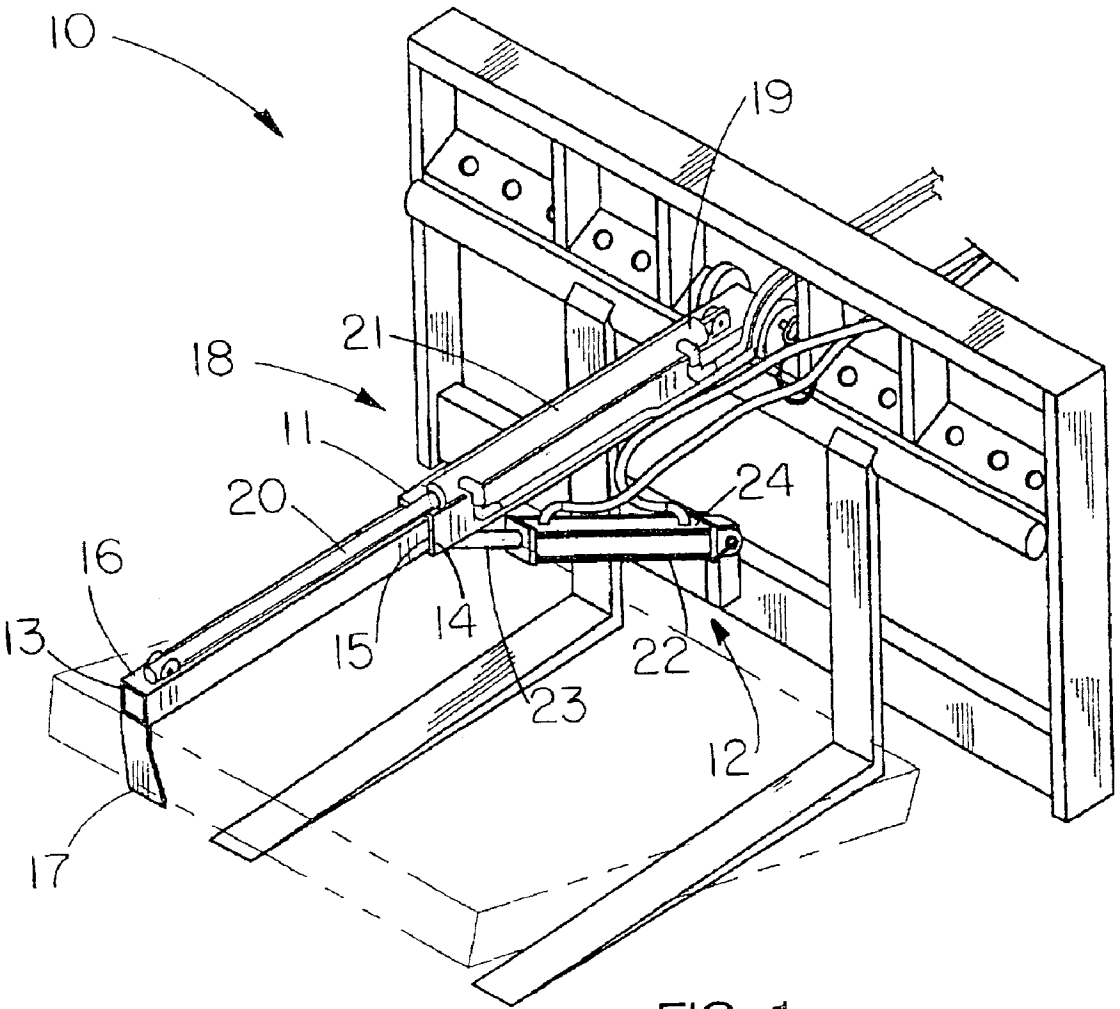
FIG. 1 is a perspective view of a new slab tipping apparatus according to the present invention shown in use.
Figure 2:
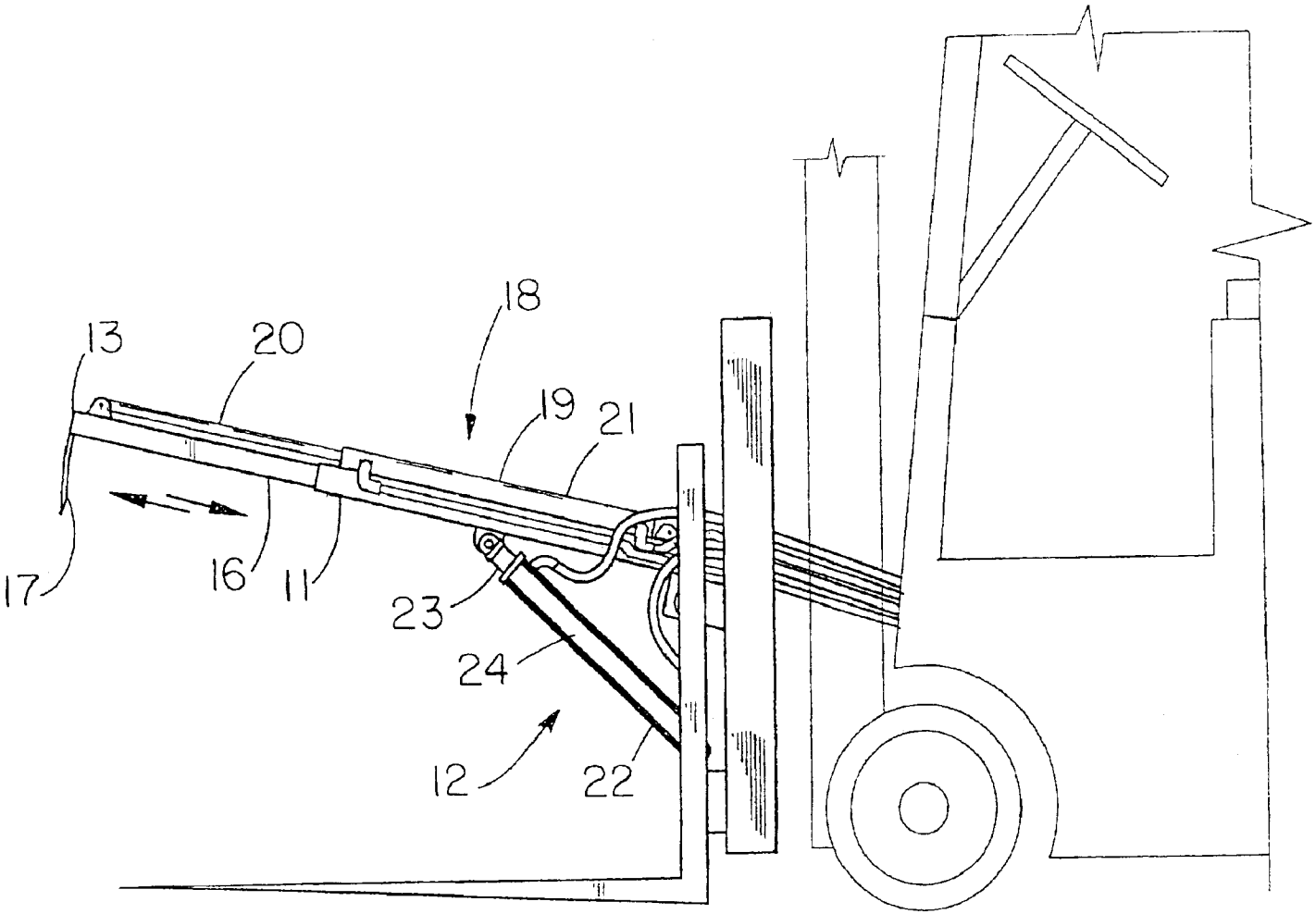
FIG. 2 is a side view of the present invention shown in use.
Figure 3:
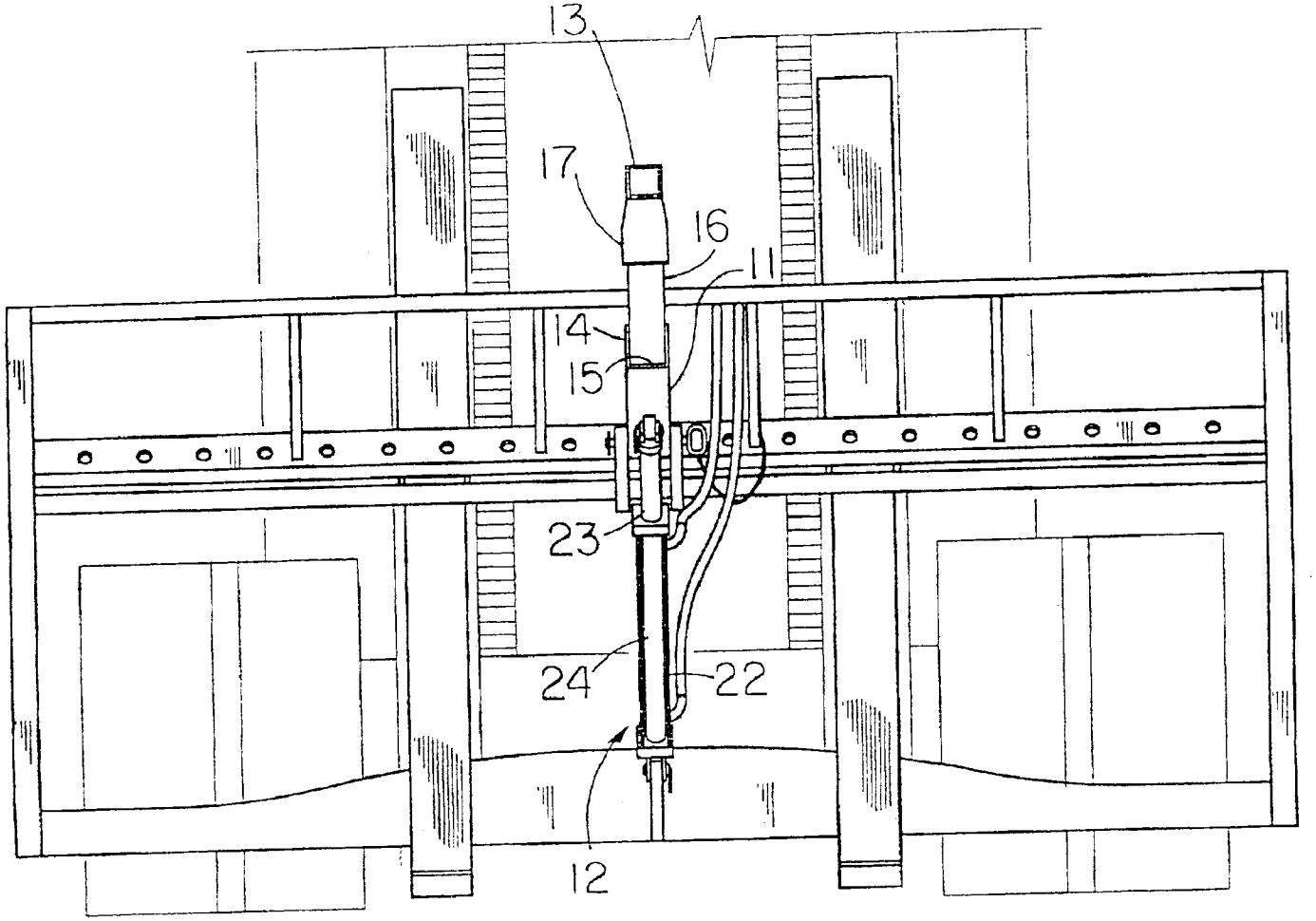
FIG. 3 is a front view of the present invention shown in use.
Figure 4:
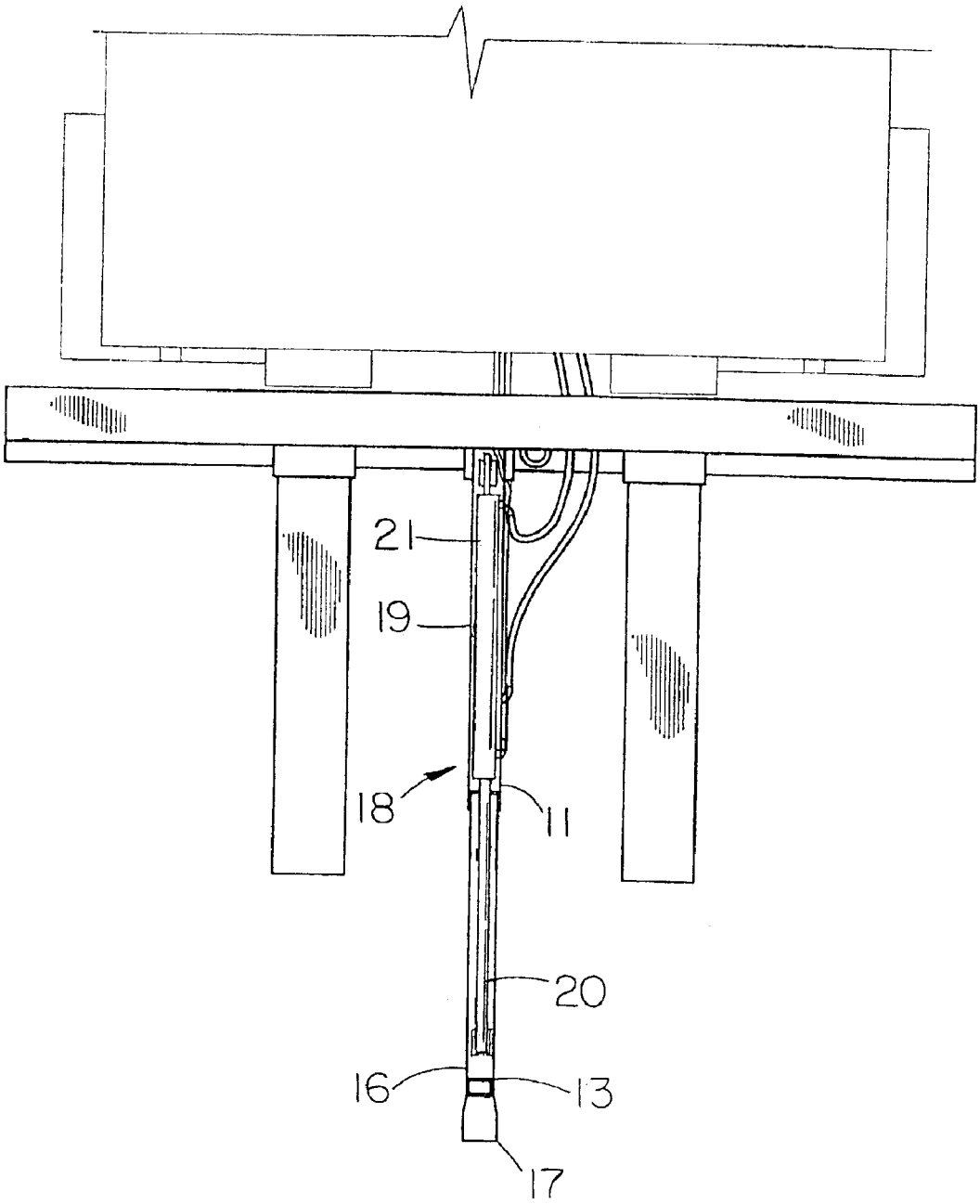
FIG. 4 is a top view of the present invention shown in use.

With reference now to the drawings, and in particular to FIGS. 1 through 4 thereof, a new slab tipping apparatus embodying the principles and concepts of the present invention and generally designated by the reference numeral 10 will be described.

As best illustrated in FIGS. 1 through 4, the slab tipping apparatus 10 generally comprises a base member 11 being designed for being selectively coupled to a carriage of the forklift whereby the base member 11 is pivotal with respect to the carriage of the forklift. The base member 11 is designed for being selectively removed from the carriage of the forklift when the base member 11 is not to be used A pivoting assembly 12 is coupled to the base member 11. The pivoting assembly 12 is designed for being selectively coupled to the carriage of the forklift whereby the pivoting assembly 12 extends between the base member 11 and the carriage of the forklift. The pivoting assembly 12 is designed for being actuated by a user for pivoting the base member 11 with respect to the carriage of the forklift.

An arm member 13 slidably engages the base member 11 whereby the arm member 13 is selectively extendable from the base member 11. The arm member 13 is designed for engaging an edge of the slab whereby the arm member 13 tips the slab onto the forks of the forklift when the pivoting assembly 12 pivots the base member 11.

The base member 11 comprises a perimeter wall 14. The perimeter wall 14 defines a lumen 15 of the base member 11 extending through the base member 11. The lumen 15 of the base member 11 slidably receives the arm member 13 whereby the arm member 13 is slidably extendable from the lumen 15 of the base member 11.

The arm member 13 comprises an arm portion 16. The arm portion 16 is slidably positioned in the lumen 15 of the base member 11 whereby the arm portion 16 is selectively extendable from the base member 11 for engaging slabs of varying dimensions. The arm member 13 comprises a pick portion 17. The pick portion 17 is coupled to the arm portion 16 whereby the pick portion 17 is positioned opposite the base member 11. The pick portion 17 is designed for engaging a side and edge of the slab for tipping the slab onto the forks of the forklift when the base member 11 is pivoted by the pivot assembly.

An extending assembly 18 is coupled to the base member 11 and the arm member 13. The extending assembly 18 slides the arm member 13 with respect to the base member 11 whereby the extending assembly 18 is for adjusting a length of the arm member 13 extending from the base member 11 when the extending assembly 18 is actuated by the user.

The extending assembly 18 comprises an extending ram 19. The extending ram 19 is coupled to the arm member 13 and the base member 11. The extending ram 19 is designed for being operationally coupled to a hydraulic system of the forklift whereby a length of the extending ram 19 is adjustable for extending and retracting the arm member 13 with respect to the base member 11 when the hydraulic assembly is selectively actuated by the user.

The extending ram 19 comprises an extending piston 20 and an extending cylinder 21. The extending piston 20 is selectively extendable from the extending cylinder 21. The extending cylinder 21 is coupled to the base member 11. The extending piston 20 is coupled to the arm member 13 whereby the arm member 13 is slid with respect to the base member 11 when the extending piston 20 is selectively extended from the extending cylinder 21. The extending cylinder 21 is designed for being operationally coupled to the hydraulic system of the forklift whereby selective actuation of the hydraulic system of the forklift selectively extends and retracts the extending piston 20 with respect to the extending cylinder 21.

The pivoting assembly 12 comprises a pivoting ram 22. The pivoting ram 22 is coupled to the base member 11. The pivoting ram 22 is designed for being coupled to the carriage of the forklift whereby the pivoting ram 22 extends between the base member 11 and the carriage of the forklift. The pivoting ram 22 is designed for being operationally coupled to a hydraulic system of the forklift whereby a length of the pivoting ram 22 is adjustable for pivoting the base member 11 with respect to carriage of the forklift when the hydraulic assembly is selectively actuated by the user.

The pivoting ram 22 comprises a pivoting piston 23 and a pivoting cylinder 24. The pivoting piston 23 is selectively extendable from the pivoting cylinder 24. The pivoting cylinder 24 is designed for being coupled to the carriage of the forklift. The pivoting piston 23 is coupled to the base member 11 whereby the base member 11 is designed for being pivoted with respect to the carriage of the forklift when the pivoting piston 23 is selectively extended from the pivoting cylinder 24. The pivoting cylinder 24 is designed for being operationally coupled to the hydraulic system of the forklift whereby selective actuation of the hydraulic system of the forklift selectively extends and retracts the pivoting piston 23 with respect to the pivoting cylinder 24.

In use, the user actuates the hydraulic system to extend the extending piston 20 from the extending cylinder 21 and thereby adjust the length of the portion extending from the base member 11. The pivoting assembly 12 is then used to pivot the base member 11 so that the pick portion 17 of the arm member 13 is positioned around the side and edge of the slab. The extending assembly 18 and the pivot assembly are used in conjunction to positioned the slab onto the forks of the forklift. When the user is read to deposit the slab on a pallet the user actuates the pivot assembly to pivot the base member 11 with respect to the carriage of the forklift to position the arm member 13 and the base member 11 out of the way of the slab being deposited on the pallet.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A slab tipping apparatus for manipulating a slab on forks of a forklift, the slab tipping apparatus comprising:

a base member being adapted for being selectively coupled to a carriage of the forklift such that said base member is pivotal with respect to the carriage of the forklift, said base member being adapted for being selectively removed from the carriage of the forklift when said base member is not to be used;

a pivoting assembly being coupled to said base member, said pivoting assembly being adapted for being selectively coupled to the carriage of the forklift such that said pivoting assembly extends between said base member and the carriage of the forklift, said pivoting assembly being adapted for being actuated by a user for pivoting said base member with respect to the carriage of the forklift;

an arm member slidably engaging said base member such that said arm member is selectively extendable from said base member, said arm member being adapted for engaging an edge of the slab such that said arm member tips the slab onto the forks of the forklift when said pivoting assembly pivots said base member; and a pick portion being coupled to said arm member such that said pick portion is positioned opposite said base member, said pick portion being for engaging a side and edge of the slab for tipping the slab onto the forks of the forklift when said base member is pivoted by said pivoting assembly, said pick portion being aligned with said arm member and said base member to allow optimal transfer of power from said base member to said pick portion when said pick portion is being used to tip the slab and to minimize twisting of said arm member when the side of the slab is uneven.

2. The slab tipping apparatus as set forth in claim 1, further comprising:

said base member comprising a perimeter wall, said perimeter wall defining a lumen of said base member extending through said base member, said lumen of said base member slidably receiving said arm member such that said arm member is slidably extendable from said lumen of said base member.

3. The slab tipping apparatus as set forth in claim 2, further comprising:

said arm member comprising an arm portion, said arm portion being slidably positioned in said lumen of said base member such that said arm portion is selectively extendable from said base member for engaging slabs of varying dimensions.

4. The slab tipping apparatus as set forth in claim 1, further comprising:

an extending assembly being coupled to said base member and said arm member, said extending assembly sliding said arm member with respect to said base member such that said extending assembly is for adjusting a length of said arm member extending from said base member when said extending assembly is actuated by the user.

5. The slab tipping apparatus as set forth in claim 4, further comprising:

said extending assembly comprising an extending ram, said extending ram being coupled to said arm member and said base member, said extending ram being adapted for being operationally coupled to a hydraulic system of the forklift such that a length of said extending ram is adjustable for extending and retracting said arm member with respect to said base member when the hydraulic assembly is selectively actuated by the user.

6. The slab tipping apparatus as set forth in claim 5, further comprising:

said extending ram comprising an extending piston and an extending cylinder, said extending piston being selectively extendable from said extending cylinder, said extending cylinder being coupled to said base member, said extending piston being coupled to said arm member such that said arm member is slid with respect to said base member when said extending piston is selectively extended from said extending cylinder, said extending cylinder being adapted for being operationally coupled to the hydraulic system of the forklift such that selective actuation of the hydraulic system of the forklift selectively extends and retracts said extending piston with respect to said extending cylinder.

7. The slab tipping apparatus as set forth in claim 1, further comprising:

said pivoting assembly comprising a pivoting ram, said pivoting ram being coupled to said base member, said pivoting ram being adapted for being coupled to the carriage of the forklift such that said pivoting ram extends between said base member and the carriage of the forklift, said pivoting ram being adapted for being operationally coupled to a hydraulic system of the forklift such that a length of said pivoting ram is adjustable for pivoting said base member with respect to carriage of the forklift when the hydraulic assembly is selectively actuated by the user.

8. The slab tipping apparatus as set forth in claim 7, further comprising:

said pivoting ram comprising a pivoting piston and a pivoting cylinder, said pivoting piston being selectively extendable from said pivoting cylinder, said pivoting cylinder being adapted for being coupled to the carriage of the forklift, said pivoting piston being coupled to said base member such that said base member is adapted for being pivoted with respect to the carriage of the forklift when said pivoting piston is selectively extended from said pivoting cylinder, said pivoting cylinder being adapted for being operationally coupled to the hydraulic system of the forklift such that selective actuation of the hydraulic system of the forklift selectively extends and retracts said pivoting piston with respect to said pivoting cylinder.

9. A slab tipping apparatus for manipulating a slab on forks of a forklift, the slab tipping apparatus comprising:

a base member being adapted for being selectively coupled to a carriage of the forklift such that said base member is pivotal with respect to the carriage of the forklift, said base member being adapted for being selectively removed from the carriage of the forklift when said base member is not to be used;

a pivoting assembly being coupled to said base member, said pivoting assembly being adapted for being selectively coupled to the carriage of the forklift such that said pivoting assembly extends between said base member and the carriage of the forklift, said pivoting assembly being adapted for being actuated by a user for pivoting said base member with respect to the carriage of the forklift;

an arm member slidably engaging said base member such that said arm member is selectively extendable from said base member, said arm member being adapted for engaging an edge of the slab such that said arm member tips the slab onto the forks of the forklift when said pivoting assembly pivots said base member;

said base member comprising a perimeter wall, said perimeter wall defining a lumen of said base member extending through said base member, said lumen of said base member slidably receiving said arm member such that said arm member is slidably extendable from said lumen of said base member;

said arm member comprising an arm portion, said arm portion being slidably positioned in said lumen of said base member such that said arm portion is selectively extendable from said base member for engaging slabs of varying dimensions;

said arm member comprising a pick portion, said pick portion being coupled to said arm portion such that said pick portion is positioned opposite said base member, said pick portion being adapted for engaging a side and edge of the slab for tipping the slab onto the forks of the forklift when said base member is pivoted by said pivot assembly, said pick portion being aligned with said arm portion and said base member to allow optimal transfer of power from said base member to said pick portion when said pick portion is being used to tip the slab and to minimize twisting of said arm member when the side of the slab is uneven;

an extending assembly being coupled to said base member and said arm member, said extending assembly sliding said arm member with respect to said base member such that said extending assembly is for adjusting a length of said arm member extending from said base member when said extending assembly is actuated by the user;

said extending assembly comprising an extending ram, said extending ram being coupled to said arm member and said base member, said extending ram being adapted for being operationally coupled to a hydraulic system of the forklift such that a length of said extending ram is adjustable for extending and retracting said arm member with respect to said base member when the hydraulic assembly is selectively actuated by the user;

said extending ram comprising an extending piston and an extending cylinder, said extending piston being selectively extendable from said extending cylinder, said extending cylinder being coupled to said base member, said extending piston being coupled to said arm member such that said arm member is slid with respect to said base member when said extending piston is selectively extended from said extending cylinder, said extending cylinder being adapted for being operationally coupled to the hydraulic system of the forklift such that selective actuation of the hydraulic system of the forklift selectively extends and retracts said extending piston with respect to said extending cylinder;

said pivoting assembly comprising a pivoting ram, said pivoting ram being coupled to said base member, said pivoting ram being adapted for being coupled to the carriage of the forklift such that said pivoting ram extends between said base member and the carriage of the forklift, said pivoting ram being adapted for being operationally coupled to a hydraulic system of the forklift such that a length of said pivoting ram is adjustable for pivoting said base member with respect to carriage of the forklift when the hydraulic assembly is selectively actuated by the user; and said pivoting ram comprising a pivoting piston and a pivoting cylinder, said pivoting piston being selectively extendable from said pivoting cylinder, said pivoting cylinder being adapted for being coupled to the carriage of the forklift, said pivoting piston being coupled to said base member such that said base member is adapted for being pivoted with respect to the carriage of the forklift when said pivoting piston is selectively extended from said pivoting cylinder, said pivoting cylinder being adapted for being operationally coupled to the hydraulic system of the forklift such that selective actuation of the hydraulic system of the forklift selectively extends and retracts said pivoting piston with respect to said pivoting cylinder.

10. A slab tipping apparatus for manipulating a slab on forks of a forklift, the slab tipping apparatus comprising:

a base member being adapted for being selectively coupled to a carriage of the forklift such that said base member is pivotal with respect to the carriage of the forklift, said base member being adapted for being selectively removed from the carriage of the forklift when said base member is not to be used;

a pair of forks mounted on said base member at laterally-spaced locations;

a pivoting assembly being coupled to said base member, said pivoting assembly being adapted for being selectively coupled to the carriage of the forklift such that said pivoting assembly extends between said base member and the carriage of the forklift, said pivoting assembly being adapted for being actuated by a user for pivoting said base member with respect to the carriage of the forklift;

an arm member slidably engaging said base member such that said arm member is selectively extendable from said base member, said arm member being adapted for engaging an edge of the slab such that said arm member tips the slab onto the forks of the forklift when said pivoting assembly pivots said base member; and a pick portion being coupled to said arm member such that said pick portion is positioned opposite said base member, said pick portion being for engaging a side and edge of the slab for tipping the slab onto the forks of the forklift when said base member is pivoted by said pivoting assembly, said pick portion comprises a width equal to a width of said arm member wherein said pick portion is mounted on said base member between the laterally-spaced locations at which said forks of said pair of forks are mounted on said base member.

11. The slab tipping apparatus as set forth in claim 10, further comprising:

said base member comprising a perimeter wall, said perimeter wall defining a lumen of said base member extending through said base member, said lumen of said base member slidably receiving said arm member such that said arm member is slidably extendable from said lumen of said base member.

12. The slab tipping apparatus as set forth in claim 11, further comprising:

said arm member comprising an arm portion, said arm portion being slidably positioned in said lumen of said base member such that said arm portion is selectively extendable from said base member for engaging slabs of varying dimensions.

13. The slab tipping apparatus as set forth in claim 10, further comprising:

an extending assembly being coupled to said base member and said arm member, said extending assembly sliding said arm member with respect to said base member such that said extending assembly is for adjusting a length of said arm member extending from said base member when said extending assembly is actuated by the user.

14. The slab tipping apparatus as set forth in claim 13, further comprising:

said extending assembly comprising an extending ram, said extending ram being coupled to said arm member and said base member, said extending ram being adapted for being operationally coupled to a hydraulic system of the forklift such that a length of said extending ram is adjustable for extending and retracting said arm member with respect to said base member when the hydraulic assembly is selectively actuated by the user.

15. The slab tipping apparatus as set forth in claim 14, further comprising:

said extending ram comprising an extending piston and an extending cylinder, said extending piston being selectively extendable from said extending cylinder, said extending cylinder being coupled to said base member, said extending piston being coupled to said arm member such that said arm member, is slid with respect to said base member when said extending piston is selectively extended from said extending cylinder, said extending cylinder being adapted for being operationally coupled to the hydraulic system of the forklift such that selective actuation of the hydraulic system of the forklift selectively extends and retracts said extending piston with respect to said extending cylinder.

16. The slab tipping apparatus as set forth in claim 10, further comprising:

said pivoting assembly comprising a pivoting ram, said pivoting ram being coupled to said base member, said pivoting ram being adapted for being coupled to the carriage of the forklift such that said pivoting ram extends between said base member and the carriage of the forklift, said pivoting ram being adapted for being operationally coupled to a hydraulic system of the forklift such that a length of said pivoting ram is adjustable for pivoting said base member with respect to carriage of the forklift when the hydraulic assembly is selectively actuated by the user.

17. The slab tipping apparatus as set forth in claim 16, further comprising:

said pivoting ram comprising a pivoting piston and a pivoting cylinder, said pivoting piston being selectively extendable from said pivoting cylinder, said pivoting cylinder being adapted for being coupled to the carriage of the forklift, said pivoting piston being coupled to said base member such that said base member is adapted for being pivoted with respect to the carriage of the forklift when said pivoting piston is selectively extended from said pivoting cylinder, said pivoting cylinder being adapted for being operationally coupled to the hydraulic system of the forklift such that selective actuation of the hydraulic system of the forklift selectively extends and retracts said pivoting piston with respect to said pivoting cylinder.

* * * * *